US006158206A

United States Patent [19]

Rosenwasser et al.

[11] Patent Number: 6,158,206

[45] Date of Patent: Dec. 12, 2000

[54] MODIFIED GAP FOR JEWELRY ROPE CHAIN LINK

[75] Inventors: David Rosenwasser; Avram Moshe Rosenwasser, both of Demerest, N.J.

[73] Assignee: D&W Jewelry, Inc., New York, N.Y.

[21] Appl. No.: 09/375,738

[22] Filed: Aug. 17, 1999

[51] Int. Cl.[7] ..... B21L 5/02; F16G 13/00

[52] U.S. Cl. ..... 59/80; 59/3; 59/83

[58] Field of Search ..... 59/80, 78, 3, 83; D11/13

[56] References Cited

U.S. PATENT DOCUMENTS

| | | | |
|---|---|---|---|
| D. 329,828 | 9/1992 | Bedoyan | D11/13 |
| D. 330,343 | 10/1992 | Bedoyan | D11/13 |
| D. 337,073 | 7/1993 | Bedoyan | D11/13 |
| 4,651,517 | 3/1987 | Benhamou et al. | 59/80 |
| 4,934,135 | 6/1990 | Rozenwasser | 59/80 |
| 4,996,835 | 3/1991 | Rozenwasser | 59/80 |
| 5,185,995 | 2/1993 | Dal Monte | 59/80 |
| 5,361,575 | 11/1994 | Rozenwasser | 59/80 |

*Primary Examiner*—David Jones
*Attorney, Agent, or Firm*—Helfgott & Karas PC.

[57] ABSTRACT

A double helix jewelry chain is constructed from a series of interconnected chain links. Each link is formed with an open mouth defined between a pair of end faces. The end faces are aligned with one another in various predetermined geometrical and dimensional relationships in order to maintain a minimum projected gap or clearance opening equal to or less than the major dimension of an elongated cross section of each link.

12 Claims, 1 Drawing Sheet

MODIFIED GAP FOR JEWELRY ROPE CHAIN LINK

BACKGROUND OF THE INVENTION

1. Field of the Invention

The present invention relates in general to fine jewelry rope chains and in particular to a link having a specialized gap for facilitating construction of such chains.

2. Description of Prior Developments

Links of numerous shapes and sizes have long been used to produce jewelry chains such as those described in U.S. Pat. Nos. 4,651,517 and 5,361,575, which are incorporated herein by reference. An ongoing goal has been to reduce the weight of metal, such as gold and silver, required to form such jewelry chains. Clearly, by reducing the weight of precious metal required to construct a chain, greater savings are achieved in the resulting jewelry product.

One approach to reducing the amount of gold required in a jewelry chain is to form each link with a cross section having an elongated or major diameter and a shorter or minor diameter. By constructing the chain with the major diameter of each link facing outwardly, the chain appears equal in size to a chain constructed of links having a circular cross section equal in diameter to the major diameter of the elongated links. However, by removing material from the minor diameter of each link, less material is used in forming the elongated links than if the links of circular cross section were used.

Although these elongated links do indeed save material, construction of chains is somewhat involved in that each link must be inserted into the gap of an adjacent link and then soldered in position. When round wire is used to construct the links, the gap in each link is typically larger than the diameter of the link wire in order to enable one link to be inserted into another. When links having elongated cross sections are used, the gap in each link can be less than the major diameter of each link but larger than the minor diameter of each link.

Of course, the gap could be made larger than both the major and minor diameters of each link, but the resulting chain constructed from such links would be very loose and difficult to hold together during assembly. In order to prevent this undesirable condition, it is preferable to construct the gap in each link with an opening less than the major diameter of each link. However, such "tight" gaps can also make the construction of chains difficult.

Accordingly, a continuing need exists for a jewelry chain link which reduces the amount of precious metal required to construct a jewelry chain, yet which produces a jewelry chain having an appearance virtually identical to those which require a greater amount of precious metal.

A further need exists for such a link which has an elongated cross section and which has a gap which produces a tight chain construction.

Still a further need exists for such a chain link which has a relatively tight gap yet is easy to assemble into a chain.

SUMMARY OF THE INVENTION

The present invention has been developed to fulfill the needs noted above and therefore has as an object the provision of a jewelry chain link which requires less precious metal than other conventional chain link designs constructed with wire having round cross sections.

Another object of the invention is the provision of a jewelry chain link having a relatively wide gap which effectively allows for the easy construction of spiral or double helix fine jewelry rope chains, yet which produces a tight chain construction during assembly and interconnection of the links.

Still another object of the invention is the provision of jewelry chain links, and jewelry chains constructed from a series of such links, wherein each link has an elongated cross section and a gap having an opening larger than both the major and minor diameters of the link cross section.

These and other objects are met by the present invention which is directed to a jewelry chain link having a gap which is greater or wider than the elongated portion of the cross section of each link. By opening up the link gap, the construction of a chain is facilitated by simplifying the insertion of one link into one or more other links. Although such links are primarily intended for use with annular gold wire having an elongated cross section, the present invention can be used with other wire cross sections as well.

The problem of loosely assembled and loosely interconnected links is solved by forming the gaps in such links with substantially parallel end walls or end faces having unequal major diameters along their elongated surfaces and unequal surface areas. The end walls or end faces extend along chord lines of unequal length directed through the annular links.

The aforementioned objects, features and advantages of the invention will, in part, be pointed out with particularity, and will, in part, become obvious from the following more detailed description of the invention, taken in conjunction with the accompanying drawings, which form an integral part thereof.

BRIEF DESCRIPTION OF THE DRAWINGS

In the drawings.

In the various figures of the drawings, like reference numerals designate like or similar parts.

DETAILED DESCRIPTION OF THE PREFERRED EMBODIMENTS

The present invention will now be described in conjunction with the drawings, beginning with FIG. 1 which shows a fine jewelry rope chain 10 constructed from a series of chain links 12 which are interconnected and linked together in a known fashion, and soldered at 11 to produce a double spiral or braided double helix form. Details of the construction and assembly of chain 10 can be found, for example, in U.S. Pat. Nos. 4,651,517 and 4,996,835.

Figure 2:
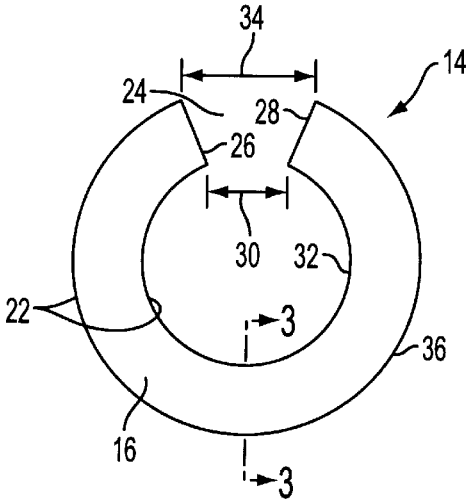
FIG. 2 (PRIOR ART)
FIG. 2 is a view of a chain link constructed in accordance with the prior art.
Figure 3:
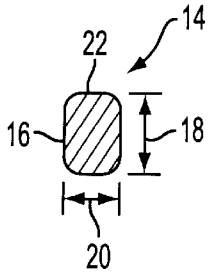
FIG. 3 (PRIOR ART)
FIG. 3 is a view in section taken through line 3—3 of FIG. 2.

Chain 10 is constructed with links 12 having elongated cross sections and with mouths or gaps formed according to the invention, but the appearance of chain 12 is virtually indistinguishable from chains constructed with links formed according to the prior art, such as link 14 shown in FIGS. 2 and 3. In this example according to the prior art, link 14 is constructed from a precious metal such as gold or silver. During the forming of each link 14, the sides 16 of the links are flattened by being coiled around a mandrel and subsequently cut loose as individual links 14.

When the links 14 are cut from the mandrel, they are formed as seen in FIG. 3 with a major cross sectional diameter or dimension 18 extending radially and substantially "parallel" to flat elongated side walls 16, and a minor cross sectional diameter or dimension 20 extending axially perpendicular to side walls 16 and substantially "parallel" to the shorter rounded side walls or ends 22. A mouth or gap 24 is defined between the opposing end walls or end faces 26,28 on each link.

Traditionally, mouth or gap 24 has been formed as shown in FIG. 2, with radially outwardly diverging end faces 26, 28. This divergence produces a relatively small inner opening 30 across the inner circumference 32 of link 14 and a relatively larger outer opening 34 across the outer circumference 36 of link 14.

The end faces 26, 28 are of substantially equal size and shape and are oriented symmetrically with one another and with respect to a diameter of link 14 which bisects gap 24. In further accordance with the prior art, the inner opening 30 has typically been dimensioned with a width less than the major dimension 18 of each link 14 and greater than the minor dimension 20 of each link 14.

In accordance with one aspect of the invention, the links 12 of FIGS. 1 and 4–9 are dimensioned with the widths of both the inner and outer openings 30, 34, greater or wider than the major dimension 18 of each link. Moreover, in further accordance with the invention, the mouth or gap 24 need not diverge radially outwardly as in the prior art, but may maintain a substantially constant spacing between end faces 26, 28 by aligning the end faces 26, 28 substantially parallel with one another and asymmetrically spaced about a link diameter parallel to either or both the end faces 26, 28.

Figure 4:
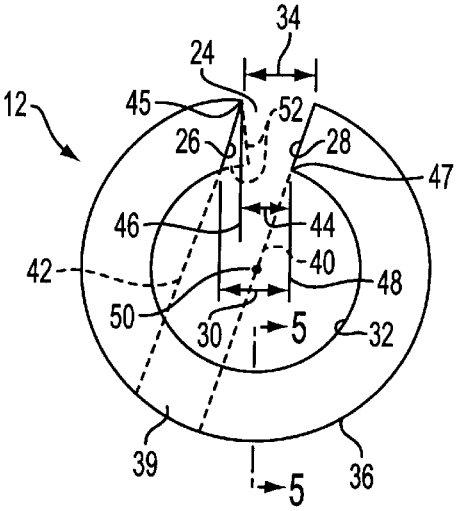
FIG. 4 is a view of a chain link constructed in accordance with a first embodiment of the invention.
Figure 5:
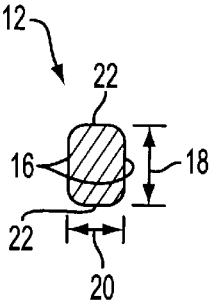
FIG. 5 is a view in section taken through line 5—5 of FIG. 4.

An illustrative embodiment of the invention is shown in FIG. 4 wherein link 12 is formed as a single coil or loop of metal, such as a loop of gold or silver having a generally annular wire body. Link 12 is formed with a pair of opposed, elongated, flat, radially-extending side walls 16 defining a major radially-extending cross sectional dimension 18 as shown in FIG. 5. Shorter, rounded, axially-extending side walls 22 define an axially-extending minor cross sectional dimension 20 which is less than dimension 18.

Figure 6:
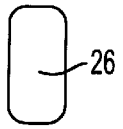
FIG. 6 is a view of the left end face of the link of FIG. 4.
Figure 7:
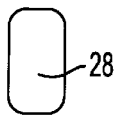
FIG. 7 is a view of the right end face of the link of FIG. 4.

Rather than forming mouth 24 with an outwardly diverging pair of end faces 26, 28 as in FIG. 2, mouth 24 of FIG. 4 is defined by a pair of substantially parallel, flat end faces 26, 28 as seen in FIGS. 6 and 7. Although neither of the end faces 26, 28 lies along a radius of link 12 as shown in FIG. 4, one end face 28 may in fact lie close to or upon a radius or diametral chord line 40 of the substantially circular link 12, with the other face 26 lying on a minor chord line 42. The maximum length or maximum radial dimension along end face 28 between the inner and outer circumferences 32, 36 is less than the corresponding maximum length or maximum radial dimension along end face 26. If end face 28 were aligned on a radius of link 12, the size and shape of end face 28 in FIG. 7 would be identical to that of the cross section of FIG. 5 taken along a radius of the link.

A significant feature of the invention is the relationship of the clearance dimension 44 with major dimension 18, the relationship of the size of the outer opening 34 with that of the inner opening 30 and the relationship of the sizes of the inner and outer openings 30, 34 with dimension 18. That is, clearance dimension 44 is less than or equal to major dimension 18, the outer opening 34 is about equal in width to the inner opening 30 and the inner and outer openings are both greater in width than major dimensions 18 and clearance dimension 44.

In one example, dimension 18, the major cross sectional dimension of link 12, is selected at 60 units of length and dimension 44 is maintained equal to or less than 60 units of length. Clearance dimension 44 is measured between parallel lines 46, 48 which are equidistant from link center 50 parallel with a diameter of annular link 12 and respectively pass through the radially outermost point 45 of end face 26 and the radially innermost point 47 of end face 28. This clearance dimension defines a nip region between lines 46 and 48.

Lines 46 and 48 are projection lines of the opening across gap or mouth 24 as viewed from a diametral extension point on the exterior of link 12. Line 46 originates at the outermost extremity 45 of end face 26 and line 48 originates at the innermost extremity 47 of end face 28. Stated another way, the projected opening width of clearance dimension 44 is equal to or less than major dimension 18 and less than the widths of the inner and outer openings 30, 34.

The inner opening 30 in FIG. 4 is about equal to or somewhat greater in circumferential length than the outer opening 34, and the circumferential midpoint of opening 30 is circumferentially rotated or displaced (to the left or counterclockwise in FIG. 4) with respect to the circumferential midpoint of the outer opening 34. In this manner, chord lines 40 and 42 are parallel, but of unequal length. The amount of weight reduction and metal savings is shown in FIG. 4 by dash lines 52 which represent the triangular surface and volume of link 14 in FIG. 2 which has been eliminated in accordance with the invention.

As noted above, clearance dimension 44 is set equal to 60 units of length, and major dimension 18 is set equal to or less than 60 units of length. In addition, the dimensions of openings 30 and 34 are set substantially equal at 75 units of length such that both openings 30 and 34 are larger than major dimension 18 and clearance dimension 44. The radius of the inner circumference 32 is set at 90 units of length and the radius of the outer circumference 36 is set at 150 units of length.

It can now be appreciated that the link 12 of FIGS. 4 through 7 provides several advantages missing from prior art links. In particular, by making the inner and outer openings 30, 34 larger than major dimension 18 and clearance dimension 44, one link can be easily inserted into another. However, by aligning end faces 26, 28 parallel with one another, and each asymmetrically aligned parallel with or at an acute angle with a radius of link 12, a radially-extending clearance channel or nip region is defined between the end faces 26, 28 within clearance dimension 44. This clearance channel across clearance dimension 44 is less than or equal in width to major dimension 18.

Figure 1:
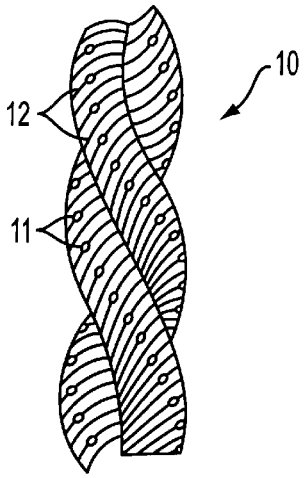
FIG. 1 is a schematic view of a portion of a rope chain constructed from a series of interengaged chain links having gap dimensions selected in accordance with the invention.

By creating a relatively tight clearance channel across clearance dimension 44, the tips or outer and inner extremities 45, 47 of end faces 26, 28 engage and nip or confine the sidewalls 16 of other links 12 assembled as shown in FIG. 1. This tight clearance defined across clearance dimension 44 eliminates the loose chain construction noted above with respect to outwardly diverging end faces 26, 28 as shown in FIG. 2, while facilitating the insertion of one link into another.

There has been disclosed heretofore the best embodiment of the invention presently contemplated. However, it is to be understood that the various changes and modifications may be made thereto without departing from the spirit of the invention.

For example, end faces 26, 28 need not be substantially parallel with one another, although they may be, and the inner opening 30 and outer opening 34 need not be equal in width, although they may be. A critical relationship which is required, however, is that clearance dimension 44 has a width less than the widths of each of the inner and outer openings 30, 34.

What is claimed is:

1. A fine jewelry chain constructed in a helical configuration from a series of chain links, and wherein each of said chain links comprises:

a substantially annular wire body formed in an open loop and having first and second opposed end faces defining a mouth therebetween, said wire body having an elongated cross section with a radially-extending major dimension and an axially-extending minor dimension which is less than said major dimension, wherein said mouth has an inner circumferentially-extending opening wider than said major dimension and an outer circumferentially-extending opening wider than said major dimension, wherein said first and second end faces have first and second extremities respectively located at said inner and outer openings and wherein said first and second extremities together define a radially-extending clearance channel having a width equal to or less than said major dimension.

2. The chain of claim 1, wherein said first and second end faces each comprises a flat surface and wherein said first and second end faces have unequal areas.

3. The chain of claim 2, wherein said first end face is radially shorter than said second end face.

4. The chain of claim 2, wherein said first and second end faces lie along first and second chord lines and wherein said first chord line is longer than said second chord line.

5. The chain of claim 4, wherein said first chord line lies close to a diametral line passing across said link.

6. The chain of claim 1, wherein said first and second end faces extend parallel to a diametral line passing through the center of said loop.

7. A fine jewelry chain link, comprising:

a generally annular wire body formed in an open loop, said body having first and second confronting flat end faces defining an open mouth therebetween, said body having an elongated cross section defining an elongated radially-extending major dimension and a shorter axially-extending minor dimension, and said first end face having a maximum radial dimension and said second end face having a maximum radial dimension different from said maximum radial dimension of said first end face.

8. The link of claim 7, wherein said first and second end faces are substantially parallel with one another.

9. A fine jewelry chain constructed in a helical configuration from a series of chain links, and wherein each of said chain links comprises:

a substantially annular wire body formed in an open loop and having first and second opposed end faces defining a mouth therebetween, said wire body having an elongated cross section with a radially-extending major dimension and an axially-extending minor dimension which is less than said major dimension, wherein said mouth has an inner circumferentially-extending opening having a width wider than said major dimension and an outer circumferentially-extending opening having a width wider than said major dimension, wherein said first and second end faces have first and second extremities respectively located at said inner and outer openings and wherein said first and second extremities together define a radially-extending clearance channel having a clearance width less than said widths of said inner and outer circumferentially-extending openings.

10. The chain of claim 1, wherein said first and second end faces each comprises a flat surface and wherein said first and second end faces have unequal areas.

11. The chain of claim 2, wherein said first end face is radially shorter than said second end face.

12. The chain of claim 2, wherein said first and second end faces lie along first and second chord lines and wherein said first chord line is longer than said second chord line.

* * * * *